US010800055B2

(12) United States Patent
Takada et al.

(10) Patent No.: US 10,800,055 B2
(45) Date of Patent: Oct. 13, 2020

(54) BLADE UNIT HAIR CLIPPER

(71) Applicant: Panasonic Intellectual Property Management Co., Ltd., Osaka (JP)

(72) Inventors: Yoshihiko Takada, Shiga (JP); Hitoshi Ogawa, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/944,926

(22) Filed: Apr. 4, 2018

(65) Prior Publication Data

US 2018/0290317 A1 Oct. 11, 2018

(30) Foreign Application Priority Data

Apr. 11, 2017 (JP) ..... 2017-078098

(51) Int. Cl.
*B26B 19/38* (2006.01)
*B26B 19/06* (2006.01)

(52) U.S. Cl.
CPC ..... *B26B 19/3846* (2013.01); *B26B 19/06* (2013.01); *B26B 19/386* (2013.01)

(58) Field of Classification Search
CPC .... B26B 19/3846; B26B 19/06; B26B 19/386
USPC ..... 30/208
See application file for complete search history.

(56) References Cited

U.S. PATENT DOCUMENTS

| | | | | |
|---|---|---|---|---|
| 4,512,077 | A * | 4/1985 | Tanabe | B26B 19/06 30/41 |
| 4,813,133 | A | 3/1989 | Locke et al. | |
| 9,266,245 | B2 * | 2/2016 | Kammer | B26B 19/386 |
| 2011/0016723 | A1 * | 1/2011 | Maichel | B26B 19/06 30/45 |
| 2012/0110859 | A1 * | 5/2012 | Kammer | B26B 19/06 30/223 |
| 2014/0059866 | A1 | 3/2014 | Ogawa | |
| 2018/0290317 | A1 * | 10/2018 | Takada | B26B 19/3846 |

FOREIGN PATENT DOCUMENTS

| | | | |
|---|---|---|---|
| DE | 102007050379 | A1 | 4/2009 |
| EP | 1535708 | A1 | 6/2005 |
| EP | 1935586 | A1 | 6/2008 |
| EP | 2450161 | A1 | 5/2012 |

(Continued)

OTHER PUBLICATIONS

Extended European Search Report dated Sep. 10, 2018 for the related European Patent Application No. 18163085.6.

*Primary Examiner* — Hwei-Siu C Payer
(74) *Attorney, Agent, or Firm* — McDermott Will & Emery LLP

(57) ABSTRACT

A blade unit can be attached to a hair clipper body. The blade unit has: a stationary blade part including stationary blades that are disposed side by side like teeth of a comb; a movable blade part including movable blades that are disposed side by side like teeth of a comb; and a base holding the stationary blade part and the movable blade part so as to allow reciprocation of the movable blade part. The base includes a rib extending along the stationary blades. This configuration enables the rib to prevent the stationary blades from biting into skin and thus can mitigate a skin stimulus.

8 Claims, 3 Drawing Sheets

(56) References Cited

FOREIGN PATENT DOCUMENTS

| | | | | |
|---|---|---|---|---|
| EP | 3 388 205 | A1 | * | 10/2018 |
| JP | 51-101292 | U | | 8/1976 |
| JP | 54-154664 | A | | 12/1979 |
| JP | 2014-045806 | A | | 3/2014 |
| WO | 2009/024900 | A1 | | 2/2009 |

* cited by examiner

BLADE UNIT HAIR CLIPPER

RELATED APPLICATIONS

This application claims the benefit of Japanese Application No. 2017-078098, filed on Apr. 11, 2017, the disclosure of which is incorporated in its entirety by reference herein.

BACKGROUND

1. Technical Field

The present disclosure relates to a blade unit attached to a hair clipper body for cutting hair and to a hair clipper including the blade unit.

2. Description of the Related Art

Unexamined Japanese Patent Publication No. 2014-45806 presents an electric hair clipper used to cut hair. The electric hair clipper includes a housing having a driving source and a battery built-in and a replaceable blade unit attached to an end of the housing. Hair removal using such an electric hair clipper is performed by sliding a blade unit equipped with projecting stationary blades and movable blades along a skin surface.

SUMMARY

Sometimes electric hair clippers are used to remove hair on relatively soft areas as well as relatively hard parts such as heads and jaws. In particular, if a person has his/her hair on a relatively soft area removed by another person's handling, the person whose hair is being removed can sometimes feel pain by an irritation clue to the edge of a blade strongly touching the person's skin.

The present disclosure has been accomplished in view of the above problem, and it is an object of the present disclosure to provide an electric hair clipper-use blade unit that enables the mitigation of a skin stimulus and a hair clipper including the blade unit.

To accomplish the object described above, an aspect of the present disclosure provides a blade unit attached to a hair clipper body. The blade unit has: a stationary blade part including a plurality of stationary blades that are disposed side by side like teeth of a comb; a movable blade part including a plurality of movable blades that are disposed side by side like teeth of a comb; and a base holding the stationary blade part and the movable blade part so as to allow reciprocation, of the movable blade part. The base includes a rib extending along the stationary blades.

This configuration enables the rib to prevent the stationary blades from biting into skin and thus can mitigate a skin stimulus.

Preferably, the rib is disposed at an opposite side of the stationary blade part from the movable blade part.

This configuration allows the blade unit to cut hair shorter.

Preferably, the rib is disposed at a distance from the stationary blades.

This configuration prevents hair from being caught between the stationary blades and the rib and being pulled out.

Preferably, the rib extends to a level of cutting edges of the stationary blades.

This configuration can mitigate a skin stimulus more effectively.

Preferably, the rib has a width such that the rib covers one of the stationary blades and leaves a gap between the rib and each of the stationary blades adjacent to the rib.

This configuration hinders the rib from posing an obstacle at the time of hair removal while allowing the rib to maintain improved mitigation of skin stimulus.

Preferably, the blade unit further includes edge ribs being each wider than the rib and being disposed at locations corresponding to both ends of the side-by-side disposed stationary blades.

The ends of the stationary blades in particular stimulate skin if they bite into the skin. The edge ribs covering the ends of the stationary blades enable these blades to mitigate skin stimulus more effectively.

Preferably, the base includes a plurality of ribs including the rib, and these ribs are disposed at intervals that are each an integral multiple of a distance between the adjacent stationary blades.

This configuration hinders any of the ribs from posing an obstacle at the time of hair removal and can mitigate a skin stimulus.

Preferably, the rib is disposed such that the rib covers one of the stationary blades in a direction of normal to a plane on which the movable blade part reciprocates.

This configuration effectively prevents the stationary blades from biting into skin and enables improved mitigation of skin stimulus.

According to the present disclosure, a blade unit attached to a hair clipper an mitigate a skin stimulus.

DETAILED DESCRIPTION

An exemplary embodiment of a blade unit according to the present disclosure will now be described with reference to the drawings. Note that the following exemplary embodiment simply shows an example of the blade unit according to the present disclosure. Therefore, the scope of the present disclosure is defined by the wording of the claims with reference to the following exemplary embodiment, and the present disclosure is not limited only to the following exemplary embodiment. Thus, among the structural elements in the exemplary embodiment below, the structural elements not recited in the independent claim representing the superordinate concept of the present disclosure are not necessarily needed to meet the challenges of the present disclosure, but are described as a more preferable embodiment.

The drawings are schematic illustrations in which emphasis, omission, and adjustment in proportion are made as appropriate to illustrate the present disclosure, and may differ from the actual apparatus in its shape, positional relationship, and proportion.

Figure 1:
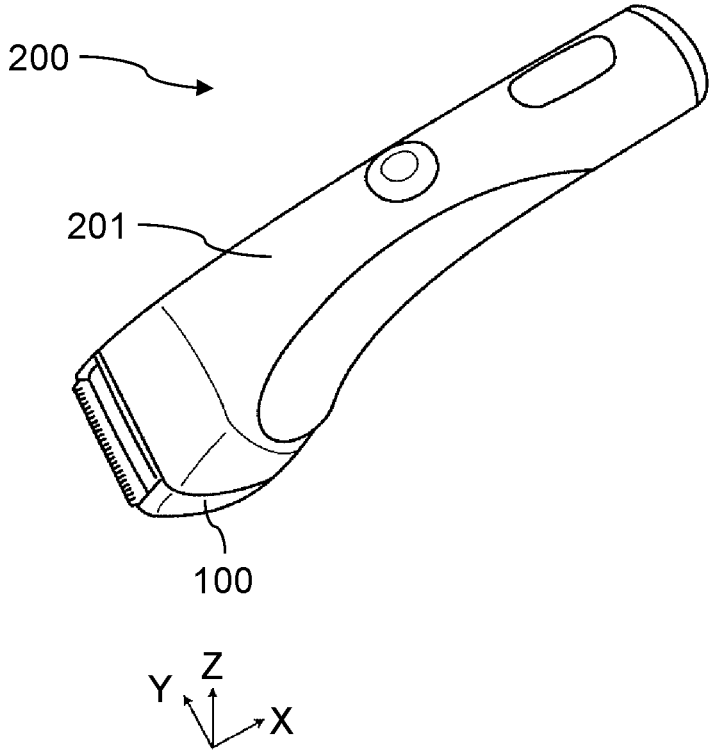
FIG. 1 is a perspective view illustrating a hair clipper including a blade unit attached to a hair clipper body.

FIG. 1 is a perspective view illustrating a hair clipper including a blade unit attached to a hair clipper body.

As shown in the drawing, hair clipper 200 is an electric hair clipper for cutting hair and includes hair clipper body 201 and blade unit 100.

Hair clipper body 201 includes a housing that is shaped like a tube so as to allow holding of the hair clipper with one hand, as well as a driving source and a battery that are disposed inside the housing. Hair clipper body 201 has a shaft (not shown) at a front end to which blade unit 100 is detachably attached. The shaft is connected to a movable blade part (described later) of blade unit 100 and gets the movable blade part to reciprocate.

In the description herein, components are illustrated as appropriate with reference to a three dimensional Cartesian coordinate system in the drawings, where an x-axis is equivalent to a direction along which stationary blades (described later) extend, a y-axis is a direction along which the stationary blades are disposed side by side, and a z-axis is a direction orthogonal to the x- and y-axes.

Figure 2:
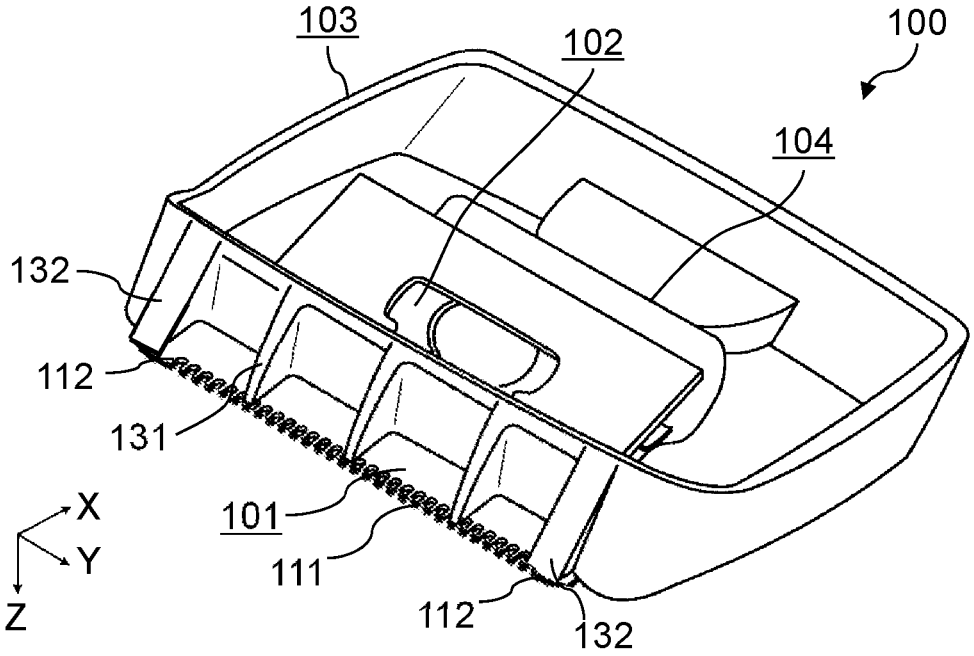
FIG. 2 is a perspective view illustrating the blade unit, viewed from the hair clipper body.

FIG. 2 is a perspective view illustrating the blade unit, viewed from the hair clipper body.

As shown in the drawing, blade unit 100 includes stationary blade part 101, movable blade part 102, and base 103. Lifting spring 104 is disposed between base 103 and movable blade part 102 to press movable blade part 102 against stationary blade part 101.

Stationary blade part 101 is a component made from sheet metal. Stationary blade part 101 integrates a plurality of stick-shaped rectangular stationary blades 111 that are disposed side by side like teeth of a comb. In this exemplary embodiment, stationary blade part 101 is fixed to base 103 such that stationary blades 111 project from base 103 and stationary blade part 101 is closer to hair clipper body 201 than movable blade part 102 is. In this exemplary embodiment, stationary blades 111 located at both ends of the plurality of stationary blades 111 are wider (in length along the y-axis in the drawings) than the rest of stationary blades 111 disposed inside. Wider stationary blades 111 located at both the ends are hereinafter sometimes referred to as edge stationary blades 112. Edge stationary blades 112 each have a rounded corner at a side remote from stationary blade 111.

In common with stationary blade part 101, movable blade part 102 is a component made from sheet metal and integrates a plurality of movable blades 121 (see FIG. 5) that are disposed side by side like teeth of a comb. In this exemplary embodiment, movable blades 121 of movable blade part 102 each have a width that is substantially equal to a width of each stationary blade 111. An interval at which movable blades 121 are each disposed are identical to an interval at which stationary blades 111 of stationary blade part 101 are each disposed. A number of movable blades 121 included in movable blade part 102 is the same as a number of stationary blades 111 included in stationary blade part 101.

Movable blade part 102 is disposed between base 103 and stationary blade part 101. Movable blade part 102 is pressed by lifting spring 104 against stationary blade part 101 such that movable blade part 102 is in surface contact with and slidable along stationary blade part 101. Movable blades 121 of movable blade part 102 overlap stationary blades 111 such that cutting edges of movable blades 121 are nearer to bottoms of stationary blades 111 than cutting edges of stationary blades 111 are.

Figure 3:
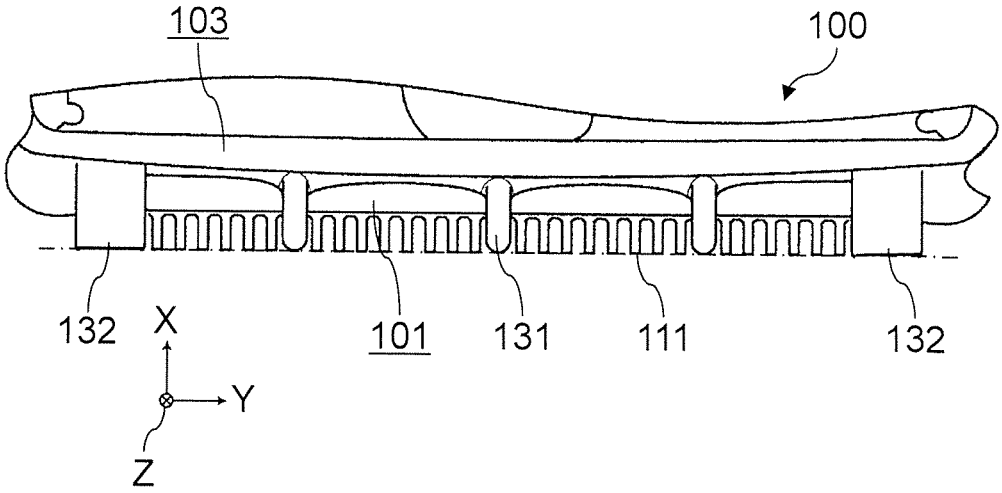
FIG. 3 is a plan view illustrating stationary blades of the blade unit and a region near the stationary blades.

FIG. 3 is a plan view illustrating stationary blades of the blade unit and a region near the stationary blades.

Figure 4:
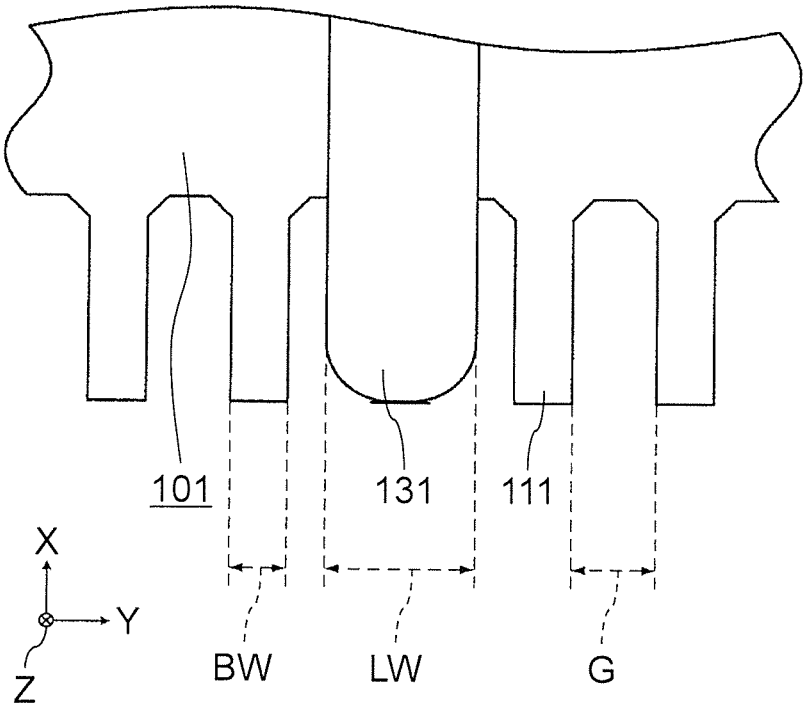
FIG. 4 is a plan view illustrating a relationship between the stationary blades and ribs of the blade unit.

FIG. 4 is a plan view illustrating a relationship between the stationary blades and ribs of the blade unit.

Figure 5:
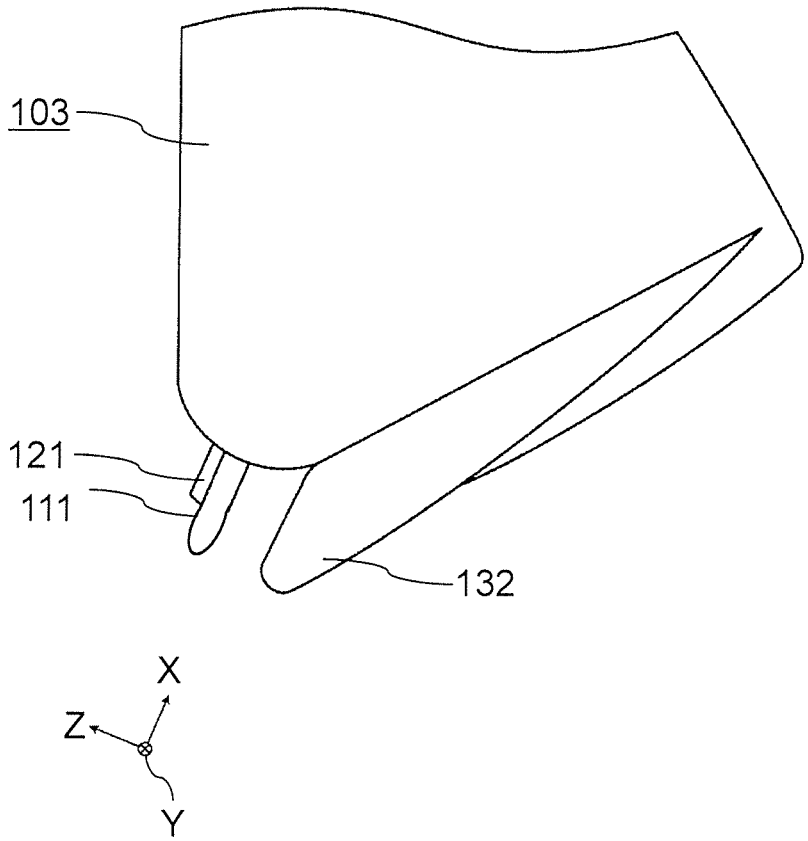
FIG. 5 is a side view illustrating relationship between the stationary blades and the ribs of the blade unit.

FIG. 5 is a side view illustrating a relationship between the stationary blades and the ribs of the blade unit.

As shown in these drawings, base 103 is a component that holds stationary blade part 101 and movable blade part 102 so as to allow reciprocation of movable blade part 102. Base 103 is detachably attached to the front end of hair clipper body 201. While base 103 is attached to hair clipper body 201, the driving source built in hair clipper body 201 and movable blade part 102 held by base 103 are connected with each other through the shaft. Base 103 includes ribs 131 that extend along stationary blades 111 so as to project from near the bottoms of stationary blades 111 toward the cutting edges of stationary blades 111.

In this exemplary embodiment, base 103 is a thin boxy resin molding. Stationary blade part 101 is fixed to base 103 such that stationary blades 111 extend outward from a corner made by a side wall and a bottom of base 103. Base 103 integrates the plurality of ribs 131 that project from an outer surface of the side wall of base 103 toward the cutting edges of stationary blades 111. Base 103 further includes edge ribs 132 that are wider than ribs 131 and disposed at locations corresponding to respective edge stationary blades 112. Ribs 131 and edge ribs 132 are disposed at an opposite side of stationary blade part 101 from movable blade part 102.

As shown in FIG. 3, ribs 131 and edge ribs 132 extend to a level of the tips of stationary blades 111. As a result, the tips of stationary blades 111 and front ends of ribs 131 and edge ribs 132 are disposed on an identical plane normal to the reciprocating direction of the movable blade. When stationary blades 111 are pressed against a soft area of a skin, ribs 131 and edge ribs 132 are simultaneously pressed against the soft area. This configuration enables the blade unit to mitigate skin stimulus.

In this exemplary embodiment, ribs 131 are each shaped like a triangle in a side view (a view along the y-axis in the drawings). The triangle gradually becomes smaller in breadth from the side wall of boxy base 103 toward the front end of rib 131.

Ribs 131 and edge ribs 132 are disposed at a predetermined distance from stationary blades 111. Pain occurs if motion of hair clipper 200 pulls out hair caught between ribs 131 and edge ribs 132 and stationary blades 111. The predetermined distance between the ribs and the blades, however, prevents this pain from occurring. This disposition also provides a margin for dimensional accuracy of resin-made base 103 to metallic stationary blade part 101 and thereby facilitates molding of base 103.

As shown in FIG. 4, rib 131 is disposed so as to cover stationary blade 111 along the z-axis in the drawing, i.e. in a direction of the normal to a plane on which movable blades 121 of movable blade part 102 reciprocate (a plane parallel to an xy-plane in the drawing). Edge ribs 132 are disposed so as to cover edge stationary blades 112 (see FIG. 3). Rib width LW, a width of rib 131, is greater than blade width BW, a width of stationary blade 111, and is narrower than blade width BW plus two gullet widths G that are each an interval between adjacent stationary blades 111. In other words, rib 131 has a width such that a gap is left between rib 131 put over one stationary blade 111 and each of stationary blades 111 adjacent to both sides of rib 131.

Because of the relationship between blade width BW and rib width LW and the positional relationship between stationary blades 111 and rib 131 as described above, a gap exists between rib 131 put over stationary blade 111 and each of stationary blades 111 adjacent to both sides of rib 131. This configuration hinders rib 131 from posing an obstacle at the time of cutting hair.

The plurality of ribs 131 that base 103 includes are disposed at intervals that are each an integral multiple of the distance between adjacent stationary blades 111. In other words, every rib 131 is disposed so as to cover stationary blade 111.

According to the exemplary embodiment described above, blade unit 100 attached to the front end of hair clipper body 201 prevents stationary blades 111 from biting into skin, especially a soft area of the skin, while removing hair. This configuration prevents irritation to the skin.

When stationary blades 111 are brought into contact with skin, stationary blades 111 are tilted at an angle relative to the skin (a tilt formed by rotation about an axis along which the cutting edges of stationary blades 111 are disposed side by side). Even at any angle of the tilt, ribs 131 extending to a level of the cutting edges of stationary blades 111 prevent stationary blades 111 from biting into the skin. This configuration prevents irritation to the skin.

When stationary blades 111 are brought into contact with skin, stationary blades 111 are tilted at an angle relative to the skin (a tilt formed by rotation about an axis normal to a plane on which movable blades 121 reciprocate). Even at any angle of the tilt, edge ribs 132, which are each wider than rib width LW of rib 131 and are disposed so as to cover edge stationary blades 112, prevent stationary blades 111 from biting into the skin. This configuration prevents irritation to the skin.

Rib width LW and the relative positional relationship between ribs 131 and stationary blades 111 are configured such that ribs 131 each do not completely cover the gullet, i.e. a gap between adjacent stationary blades 111. This configuration prevents folded-down hair, that is hair unintentionally folded down by rib 131, from being disabled from entering into the gullet. This in turn prevents failed hair removal.

The scope of the present disclosure should not be limited to the exemplary embodiment described above. For example, any combination of the components described herein or another exemplary embodiment implemented without some of the components may be included within the scope of the present disclosure. The scope of the present disclosure should include modifications and variations since those skilled in the art can add various design changes to the exemplary embodiment described above without deviating from the spirit and scope of the present disclosure as defined by the appended claims.

In the exemplary embodiment described above, ribs 131 are disposed at an opposite side of stationary blades 111 from movable blades 121, for example. The present disclosure, however, does not rule out any mode in which movable blades 121 are disposed between stationary blades 111 and ribs 131.

In the exemplary embodiment described above, three ribs 131 are disposed between edge ribs 132. No edge ribs 132 may be disposed. The number of ribs 131 may be just one.

Rib 131 may have any shape other than the tapered shape that becomes smaller in breadth toward the front end of the rib.

The present disclosure can be applied to hair clippers for removing hair. The present disclosure can be applied to a replaceable blade unit for a medical hair clipper, for example.

What is claimed is:

1. A blade unit which is attachable to a hair clipper body, the blade unit comprising:

a stationary blade part including a plurality of stationary blades that are disposed side by side like teeth of a comb;

a movable blade part including a plurality of movable blades that are disposed side by side like teeth of a comb; and a base holding the stationary blade part and the movable blade part so as to allow reciprocation of the movable blade part, wherein the base includes a plurality of ribs extending along the stationary blades and edge ribs disposed at locations corresponding to both ends of the stationary blade part, each of the edge ribs is wider than each of the plurality of ribs, the plurality of ribs and the edge ribs are disposed at one side of the stationary blade part opposite from the movable blade part, and tips of the plurality of stationary blades, front ends of the plurality of ribs and front ends of the edge ribs are disposed on an identical plane normal to a direction in which the plurality of stationary blades, the front ends of the plurality of ribs and the front ends of the edge ribs extend.

2. The blade unit according to claim 1, wherein the plurality of ribs and the edge ribs are disposed at a distance from the stationary blades.

3. The blade unit according to claim 1, wherein each of the plurality of ribs has a width such that a gap is left between the each of the plurality of ribs covering one of the plurality of stationary blades and each of the plurality of stationary blades adjacent to both sides of the each of the plurality of ribs, the one of the plurality of stationary blades adjacent and being among the plurality of stationary blades.

4. The blade unit according to claim 1, wherein the plurality of ribs are disposed at intervals that are each an integral multiple of a distance between adjacent stationary blades of the plurality of stationary blades.

5. The blade unit according to claim 1, wherein each of the plurality of ribs is disposed such that the each of the plurality of ribs covers one of the plurality of stationary blades in a direction normal to a plane on which the movable blade part reciprocates.

6. A hair clipper comprising:

a hair clipper body; and the blade unit according to claim 1 attached to the hair clipper body.

7. The blade unit according to claim 3, wherein the plurality of ribs and the edge ribs are disposed at a distance from the plurality of stationary blades.

8. The blade unit according to claim 1, wherein each of the plurality of ribs has a tapered shape, which gradually becomes smaller in breadth toward the front ends of the plurality of ribs.

* * * * *